US006216924B1

(12) United States Patent
Orr et al.

(10) Patent No.: US 6,216,924 B1
(45) Date of Patent: Apr. 17, 2001

(54) PRESSURE TUBE

(75) Inventors: David B. Orr, Wellsville, OH (US); Yusuke Shiratani, Pittsburgh, PA (US); James N. Karamanos, Seattle, WA (US); Noriaki Yamauchi, Bellwood, PA (US)

(73) Assignee: TYK America, Inc., Clairton, PA (US)

( * ) Notice: Subject to any disclaimer, the term of this patent is extended or adjusted under 35 U.S.C. 154(b) by 0 days.

(21) Appl. No.: 09/220,105

(22) Filed: Dec. 23, 1998

(51) Int. Cl.[7] ..... B22D 41/08
(52) U.S. Cl. ..... 222/594; 222/606
(58) Field of Search ..... 222/594, 606, 222/607; 164/306

(56) References Cited

U.S. PATENT DOCUMENTS

| | | | | |
|---|---|---|---|---|
| 2,852,822 | * | 9/1958 | Strom | 164/306 |
| 5,217,058 | * | 6/1993 | Sourlier | 164/306 |
| 5,329,987 | | 7/1994 | Andoh et al. | 164/306 |
| 5,947,180 | * | 9/1999 | Seyer et al. | 164/306 |
| 5,992,711 | * | 11/1999 | Mochizuki et al. | 222/606 |
| 6,024,259 | * | 2/2000 | Gardener et al. | 222/606 |

* cited by examiner

*Primary Examiner*—Scott Kastler
(74) *Attorney, Agent, or Firm*—Cohen & Grigsby P.C.

(57) ABSTRACT

A pressure tube includes a central tube section (10), an intake tube section (12) and a flared tube section (14). Flared tube section (14) includes a flange ring (54) with a shell (64) secured thereto. A contact ring (76) is received in an annular recess (82) of flange ring (54).

11 Claims, 4 Drawing Sheets

PRESSURE TUBE

BACKGROUND OF THE INVENTION

1. Field of the Invention

The subject invention is directed to apparatus for making steel and, more particularly, apparatus for transferring molten steel from a ladle to a mold.

2. Description of the Prior Art

Various apparatus and processes have been developed for manufacturing steel. In steelmaking operations, it has been found that transferring molten metal to molds presents a step by which slag or other impurities are sometimes introduced. To improve steel quality, various processes for minimizing the introduction of impurities have been developed.

Such processes have included pressure casting processes wherein molten metal is transferred through a pressure tube and into a casting. Briefly, in the pressure casting process a ladle of molten metal is placed upright in an open pressure vessel. A refractory lined lid is then placed over the vessel. One end of the pressure tube is inserted through an opening in the lid and submerged in the molten metal. The opposite end of the tube is then connected to the mold. Air is pumped into the vessel to pressurize it. The air pressure on surface of the molten metal forces the metal upwardly through the pressure tube and into the mold. The metal enters the pressure tube through the submerged end of the tube and flows through the tube and into the mold. Since the molten metal flows from a location under the metal surface near the bottom of the ladle, the process tends to avoid the entrainment of slag in the molten metal and results in a high-quality casting.

In the prior art, pressure tubes have been made of various materials including alumina graphite, zirconia-alumina, high alumina, high alumina tar impregnated and coked, and muddite.

All of these tubes have the disadvantage that their preparation requires final assembly with a metal collar. The collar is bonded to the outside surface of the tube with a castable or mortar. The collar is located adjacent to one end of the pressure tube. The opposite end of the pressure tube is inserted through the lid opening and the pressure tube is passed through the lid opening until the collar engages the pressure vessel lid. The collar is located on the pressure tube such that the collar contacts the pressure vessel lid and one end of the tube is suspended in the molten metal during pressure casting.

To assemble the tube and collar, the metal collar is placed over one end of the refractory tube. The tube is secured to the collar by a mortar or castable that is placed between the inside wall of the collar and the outside wall of the refractory tube. After the tube is thus secured to the collar, a second layer of mortar is applied to the outer surface of the tube adjacent to the innermost end of the collar. This second layer of mortar is intended to prevent leakage of air between the collar and the tube while the tube is under pressurized conditions. Air leaks at this location are particularly undesirable because the air can then become entrained in the steel as it enters the mold. If air reaches the mold cavity, the mold is usually seriously damaged or destroyed. At a minimum, this results in degradation of the steel quality.

In the prior art, air leaks between the collar and the tube were sometimes caused by slippage between the collar and the tube that resulted in cracks in the mortar. Accordingly, various structures were employed to strengthen the engagement between the collar and the pressure tube. For example, in some cases circular grooves were cut in the external surface of the tube so that the castable or mortar could flow into these grooves to better engage the tube. In another example, the tube was provided with a circular groove and a steel retaining ring that was partially received in the groove extended from the tube to provide a circular flange around the tube. This also was found to improve the engagement between the collar and the tube.

Notwithstanding such improved designs, a persistent problem with the use of such collars has been that they potentially allowed passage of air through mortar cracks or seams between the pressure tube and the collar. This also created a potential for air to become entrained in the steel and carried into the mold. Moreover, the prior art process for assembling collars to the refractory tubes required substantial labor, time and space to complete. All of these requirements significantly added to the overall cost of the pressure casting process.

Thus, there was a need in the prior art for an improved design for pressure tubes that would further reduce the likelihood that a pathway between the collar and the refractory tube would develop and entrained air would enter the mold. Preferably, an improved design could also substantially reduce requirements for time, labor and space that were associated with the collar assembly process.

SUMMARY OF THE INVENTION

In accordance with the subject invention, a pressure cast tube includes a tube body that defines an internal passageway between an intake end and a mold end. The tube body has a larger diameter at longitudinal positions adjacent to the mold end than at longitudinal positions adjacent to the intake end. The tube body also incorporates a flange ring that is located adjacent to the mold end and that extends laterally outward from the rest of the tube body. A shell is secured to the flange ring and a contact ring is connected to the shell.

Preferably, the shell that is secured to the flange ring includes an annular band that is secured to the circumferential surface of the flange ring and an upper ring that is connected to one edge of the annular band. The contact ring is secured to an edge of the annular band that is opposite from the edge that is connected to the upper ring.

More preferably, the circumferential surface of the flange ring is separated from the lateral surface of the tube body by an upper annular surface and by a lower annular surface.

Other details, objectives and advantages of the subject invention will become apparent to those skilled in the art as description of a presently preferred embodiment proceeds.

BRIEF DESCRIPTION OF THE DRAWINGS

A preferred embodiment of the subject invention is shown in the accompanying drawings wherein.

DESCRIPTION OF THE PREFERRED EMBODIMENT

Figure 1:
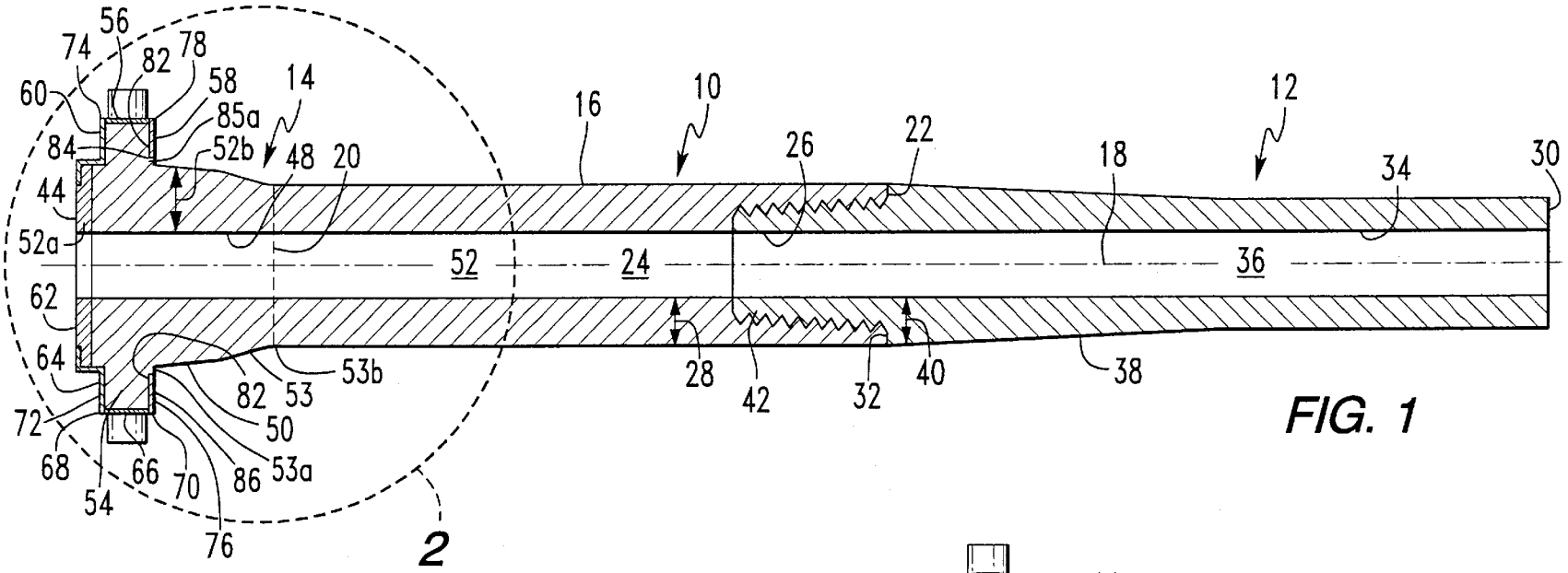
FIG. 1 is an elevational section of a pressure tube in accordance with the subject invention.
Figure 3:
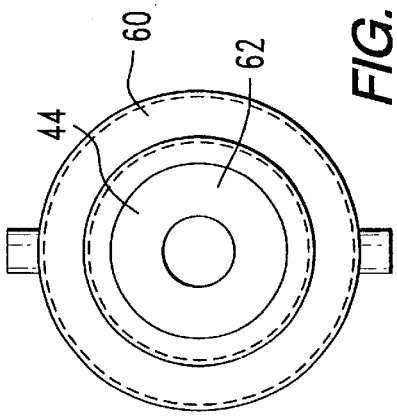
FIG. 3 is a top plan view of the complete pressure tube shown in FIG. 1.
Figure 2:
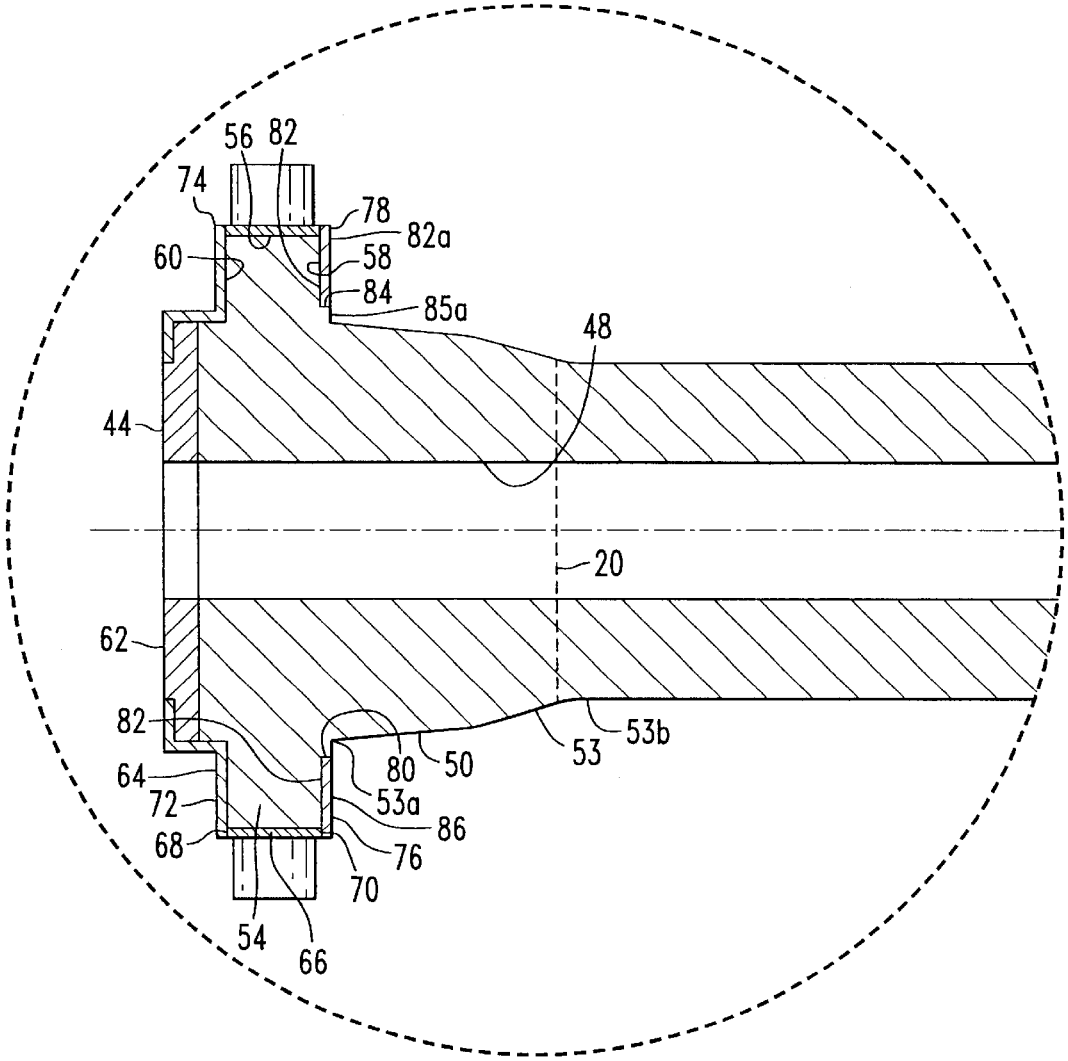
FIG. 2 is an enlarged view of the top portion of the pressure tube shown in FIG. 1.
Figure 4:
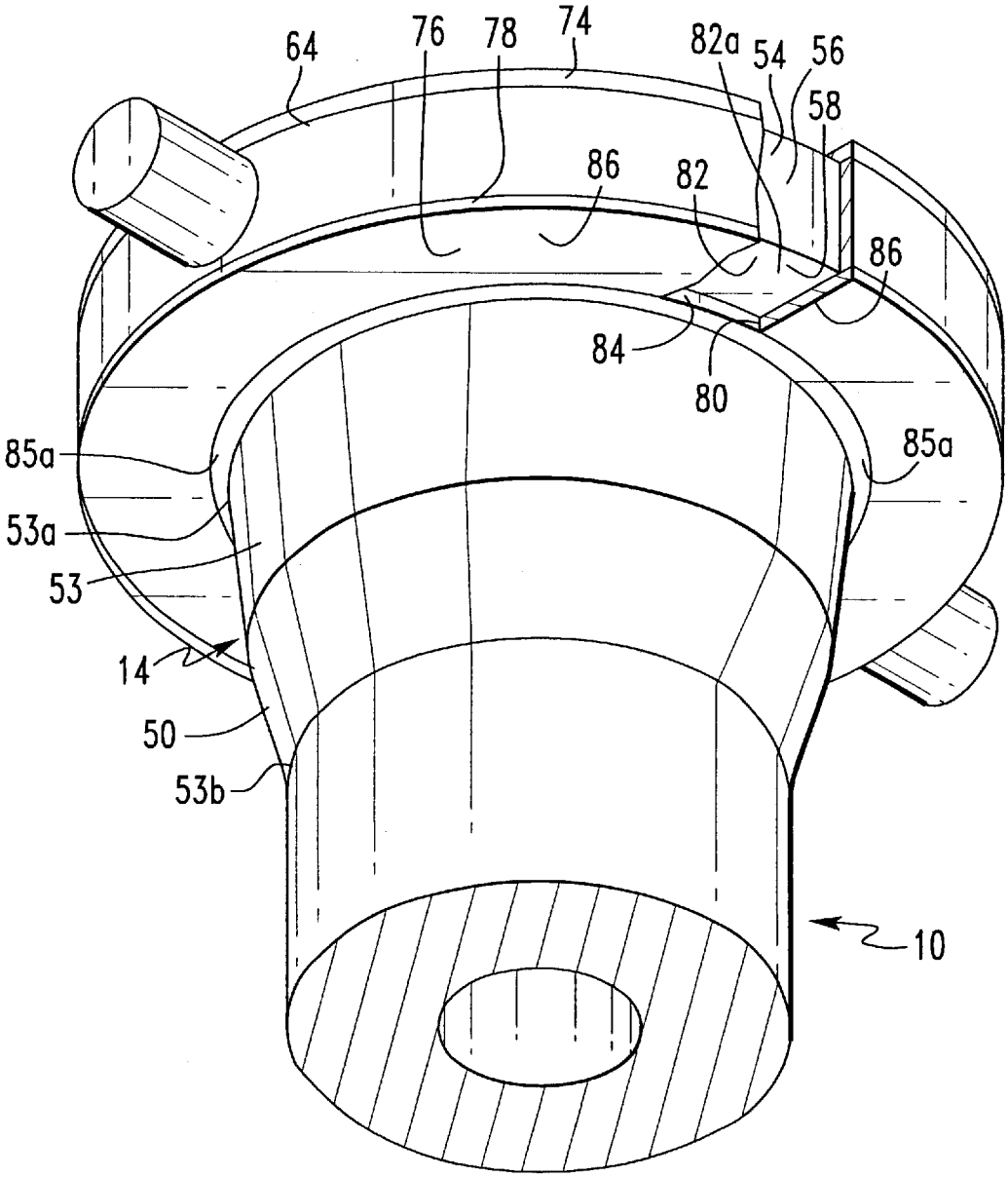
FIG. 4 is an isometric view of the top portion of the pressure tube of FIGS. 1–3 with portions thereof broken away to better disclose the structure thereof.

As shown in FIGS. 1–4, a pressure tube as herein disclosed includes a tube body that has a central tube section or region 10 with an intake tube section or tapered region 12 on one end and a flared tube section or region 14 on the other end.

Central region 10 is in the general shape of a right circular cylinder with an outer circumferential surface 16 that is spaced at a substantially constant radius from a longitudinal center axis 18. Central region 10 has a first or upper end or boundary 20 and a second or lower end 22. Central region also includes an internal passageway 24 that is defined by an internal cylindrical surface 26. Internal cylindrical surface 26 is located at a substantially constant radius from longitudinal axis 18 such that the wall thickness 28 between outer surface 16 and inner surface 26 is substantially constant over the longitudinal locations or positions of the central region 10.

Tapered region 12 is an intake tube section that is defined between an intake end or distal end face 30 and a connection end face 32. Tapered region 12 has an internal cylindrical surface 34 that defines an internal passageway 36. Tapered region 12 is aligned on longitudinal axis 18 and is secured to central region 10 such that connection end face 32 is in opposition to lower end 22. Internal passageway 36 is in communication with internal passageway 24 and internal surface 34 is located at substantially the same radius from center axis 18 as internal surface 26. Also, at the longitudinal position on tapered region 12 that is adjacent to connection end face 32, the outer surface 38 of tapered region 12 is located at substantially the same radius from longitudinal axis 18 as circumferential surface 16 so that wall thickness 40 of tapered region 12 is substantially the same as wall thickness 28 of central region 10.

At locations along longitudinal axis 18 closer to distal end face 30, outer surface 38 is located at a shorter radius from axis 18 such that tapered region 12 decreases in diameter along longitudinal axis 18 in the direction toward distal end face 30. Internal surface 34 is located at a substantially constant radius throughout the length of tapered region 12 so that wall thickness 40 diminishes in the direction toward distal end face 30. Preferably, central region 10 is secured to tapered region 12 by threaded member 42.

Flared region 14 has a mold end face 44. Flared region 14 joins central region 10 at boundary 20. Flared region 14 is in longitudinal alignment with longitudinal axis 18. Flared region 14 monolithically joins central region 10 at boundary 20. Flared region 14 includes an internal cylindrical surface 48 and an outer circumferential surface 50. Internal cylindrical surface 48 is at substantially constant radius from axis 18 at positions of flared region 14 along longitudinal axis 18 and defines an internal passageway 52 that is in communication with passageway 24 of central region 10. A portion of flared region 14 in the region near mold end face 44 is comprised of a layer of alumina-graphite 52*a*. Layer 52*a* is hardened by boron carbide so that it is resistant to physical damage caused by impacts from the molds 52*b* (FIG. 5) as they are joined to the pressure tube or removed from the pressure tube.

In the portion of flared section 14 that is adjacent to boundary 20, outer surface 50 is substantially the same radius from axis 18 as circumferential surface 16 of central region 10. Also internal surface 48 is substantially the same radius from axis 18 as internal surface 26 of central region 10. Accordingly, the wall thickness 52*b* of the portion of flared region 14 adjacent to boundary 20 is substantially the same as wall thickness 28 of central region 10.

However, the lateral or radial location of outer surface 50 increases at longitudinal positions of flared region 14 in the direction from boundary 20 toward mold end face 44 such that wall thickness 52*b* of flared region 14 is greater at longitudinal positions that are closer to mold end face 44 in comparison to other longitudinal positions. Thus, flared region 14 generally defines a fustrum 53 wherein the base 53*a* of the fustrum is closer to the mold end face 44 than the top 53*b* of the fustrum.

Additionally, flared tube section 14 includes a flange ring 54 that is an integral portion of said flared tube section 14. Flange ring 54 extends radially from outer surface 50 at a longitudinal position that is adjacent to the mold end face 44 of flared section 14. Thus, flange ring 54 is located between mold end face 44 and the base 53*a* of the fustrum 53.

In the preferred embodiment, flange ring 54 includes an outer circumferential surface such as radial surface 56 and two lateral sides 58 and 60 that extend between radial surface 56 and outer surface 50 of flared region 14. Thus, radial surface 56 extends laterally beyond the base 53*a* of fustrum 53 to form a lateral side 58 therebetween.

The pressure tube herein disclosed further includes a steel shell 64 that is secured to flange ring 54. Steel shell 64 includes an outer or annular band 66 that is secured to the boundary surface or radial surface 56 of flange ring 54. Annular band 66 has an upper lateral or side edge 68 and a lower lateral or side edge 70. Shell 64 further includes an upper ring 72 having an outer perimeter 74. Upper ring 72 is connected to upper side edge 68 of annular band 66 along perimeter 74.

A contact ring 76 has an outer perimeter edge or surface 78 and an inner annular edge or inner radial surface 80. Inner radial surface 80 is located laterally outward from the surface 50 of tube section 14 and from base 53*a* of fustrum 53. Radial face 58 includes an annular recess 82 that receives contact ring 76. Annular recess 82 is defined by lateral surface 82*a* and a circular or radial edge 84 that opposes inner annular edge or inner radial surface 80 of contact ring 76 when contact ring 76 is received in annular recess 82. The depth of annular recess 82 is determined by the longitudinal width of radial edge 84 and is substantially equal to the thickness of contact ring 76 such that the annular portion 85*a* of radial face 58 that is defined between circular edge 84 and base 53*a* of fustrum 53 is substantially coplanar with face 86 of contact ring 76. Contact ring 76 is connected to the lower side edge 70 of annular band 66 at outer perimeter surface 78.

Figure 5:
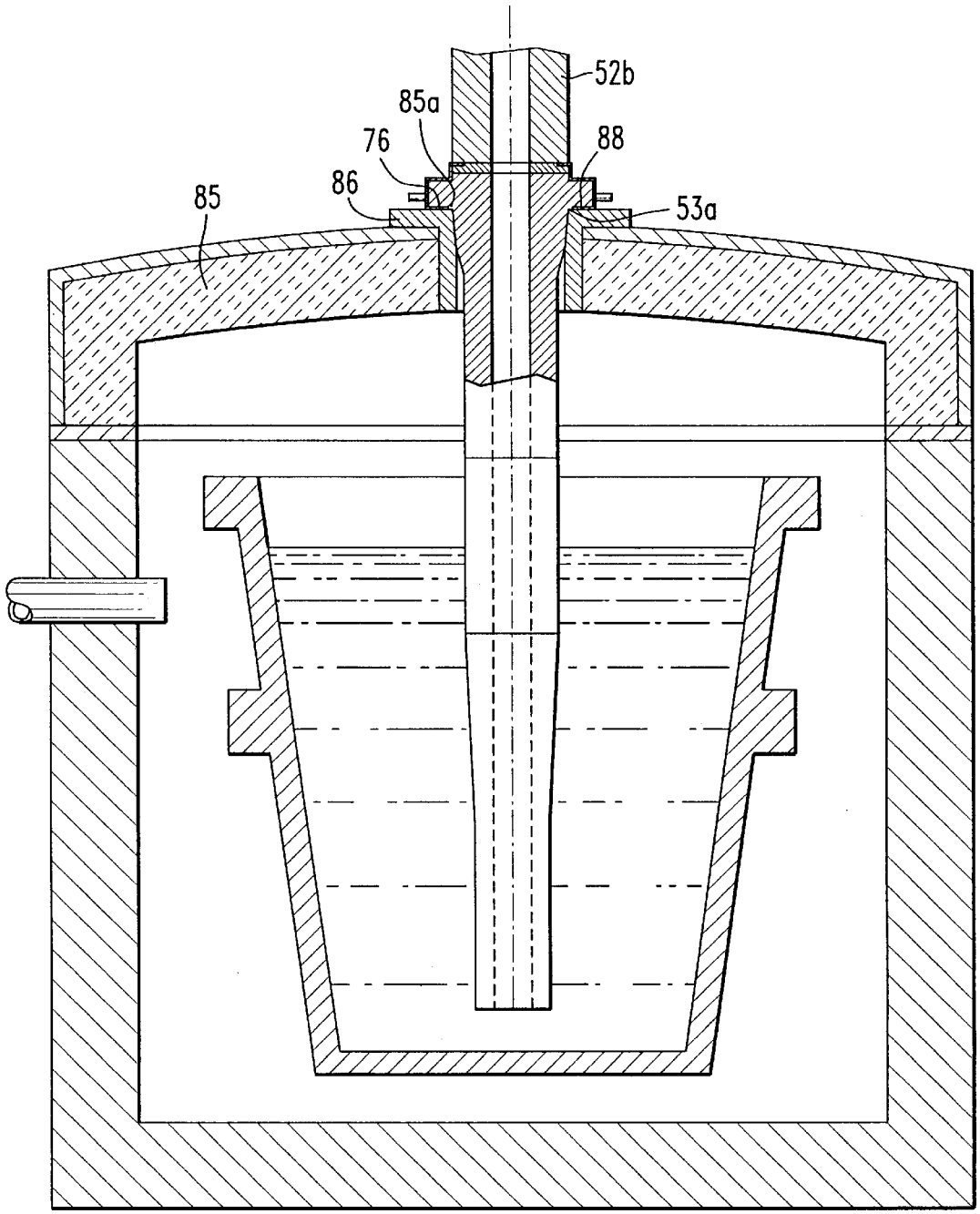
FIG. 5 is an elevational section of the pressure tube of FIGS. 1–4 mounted in a typical pressure vessel.

Referring to FIG. 5, when the pressure tube is inserted through the lid 85 of the pressure vessel, contact ring 76 engages a steel flange 86 in the lid of the pressure vessel. This creates a pressure seal between contact ring 76 and lid 85. In addition, steel flange 86 also engages the annular portion 85a of radial face 58 that is defined between circular edge 84 and base 53*a* to provide a metal-to-refractory seal. This metal-to-refractory seal has been found to be tighter than the metal-to-metal seals known in the prior art.

Also in contrast to pressure tubes known in the prior art, the surfaces of flared region 14 that are exposed to the internal pressures in the pressure vessel define a monolithic body that has no seams or joints that could be penetrated or eroded by internal gases or vapors inside the pressure vessel. The pressure tube herein disclosed does not have a steel collar or steel clading that forms a steel-alumina-graphite interface that is exposed to the internal pressure of the pressure vessel. Instead, a continuous glaze-protected surface of alumina-graphite is presented to pressure conditions. This continuous surface has been found to be more resistant to oxidation so that the pressure tube herein disclosed is found to be more durable than prior art pressure tubes.

While a presently preferred embodiment of the subject invention has been shown and described herein, other various embodiments are also included within the scope of the following claims.

What is claimed is:

1. A pressure cast tube for conducting molten metal from a vessel to a casting, said tube comprising:

a tube body having an intake end and a mold end with an outer surface between said intake end and said mold end, said tube body defining an internal passageway between said intake end and said mold end, said tube body having a cross-sectional dimension that is greater at longitudinal positions adjacent to said mold end than at longitudinal positions adjacent to said intake end, said tube body also forming a flange ring that is located at a longitudinal position adjacent to the mold end of said tube body, said flange ring defining a radial surface that is located laterally outwardly with respect to the outer surface of said tube body that is adjacent to said flange ring, said flange ring also defining at least one lateral side between the radial surface and the outer surface of the tube body that is adjacent to said flange ring, said lateral side including a radial edge with a first portion of the lateral side being located on one side of the radial edge and between the radial edge and the outer surface of the tube body that is adjacent to said flange ring, said lateral side also including a second portion that is located on the opposite side of the radial edge from the first portion and defining a recess, the first portion of the lateral side cooperating with the vessel to form a metal-to-refractory seal at times when the pressure cast tube is placed in the vessel, a shell that is secured to said tube body adjacent to said mold end, said shell including an outer band that is secured to the radial surface of the flange ring; and a contact ring that is connected to the outer band of said shell, said contact ring being received in the recess of the second portion of said lateral side.

2. The pressure cast tube of claim 1 wherein said flange ring defines a lateral surface and wherein said contact ring defines an annular surface that is substantially parallel to the lateral surface of said flange ring.

3. A pressure cast tube for conducting molten metal from a vessel to a casting, said tube comprising:

a tube body having an intake end and a mold end and having a circumferential surface between said intake end and said mold end, said tube body defining an internal passageway between said intake end and said mold end, said tube body forming a laterally extending flange ring that is located on said tube body at a longitudinal position that is adjacent to the mold end of said tube body, said flange ring having an outer circumferential surface that extends laterally outwardly from the circumferential surface of said tube body that is adjacent to said flange ring, said flange ring also having at least one lateral side between the outer circumferential surface of the flange ring and the circumferential surface of the tube body that is adjacent to said flange ring, said lateral side including a radial edge with a first portion of the lateral side being located on one side of the radial edge and between the radial edge and the circumferential surface of the tube body, said lateral side also having a second portion that is located on the opposite side of the radial edge from the first portion and that defines a recess, the first portion of the lateral side cooperating with the vessel to form a metal-to-refractory seal at times when the pressure cast tube is placed in the vessel;

an annular band that is secured to the circumferential surface of the flange ring, said annular band having an upper edge and a lower edge;

an upper ring having an outer perimeter that is connected to the upper edge of said annular band; and a contact ring having an outer perimeter and having an inner radial edge, the outer perimeter of said contact ring being connected to said annular band, said contact ring being received in the recess of the second portion of said lateral side, said contact ring contacting the vessel at times when the pressure cast tube is placed in the vessel.

4. A pressure cast tube for conducting molten metal from a vessel vertically upward to a casting; said tube comprising:

a central tube section that is substantially in the shape of a right circular cylinder said central tube section having a first end and also having a second end that is oppositely disposed from said first end;

an intake tube section that is secured to the first end of the central tube section; and a flared tube section having a tube end and an oppositely disposed mold end with said tube end being connected to the second end of said central tube section, said flared tube having an outer surface between said tube end and said mold end, with said outer surface having a larger diameter at longitudinal positions that are closer to the mold end in comparison to the diameter at other longitudinal positions that are closer to the tube end, said flared tube section also forming a flange ring having an outer circumferential surface and at least one lateral side that extends radially between the outer circumferential surface of the flange ring and the outer surface of said flared section that is adjacent to said flange ring, said flange ring being located longitudinally adjacent to the mold end of said flared tube section, said lateral side including a radial edge with a first portion of the lateral side being located on one side of the radial edge and between the radial edge and the outer surface of the flared section that is adjacent to said flange ring, said lateral side also having a second portion that is located on the opposite side of the radial edge from the first portion and that defines a recess, the first portion of the lateral side cooperating with the vessel to form a metal-to-refractory seal at times when the pressure cast tube is placed in the vessel; and a shell that is secured to the flange ring, said shell including an annular band that is secured to the outer circumferential surface of the flange ring, said annular band having an upper edge and a lower edge, said shell further including an upper ring having an outer perimeter that is connected to the upper edge of said annular band, and said shell also having a contact ring that has an outer perimeter that is connected to the lower edge of said annular band, said contact ring also having an inner radial edge that opposes the radial edge of the lateral side and that is received in the recess of the second portion of the lateral side, said contact ring contacting the vessel at times when the pressure tube is placed in the vessel.

5. The pressure tube of claim 4 wherein the flared tube section is comprised of alumina graphite and wherein the mold end of said flared tube section is further comprised of boron carbide.

6. The pressure tube of claim 4 wherein said pressure tube is comprised of alumina graphite.

7. A pressure cast tube for conveying molten metal from a pressurized vessel vertically upward to a casting, said tube comprising:

a central tube section that is substantially a right circular cylinder, said central tube section having an end face and also having an end boundary that is oppositely disposed from said end face, said central tube section also defining an internal passageway between said end face and said end boundary;

an intake tube section that has a distal end face and a connection end face, said intake tube section being secured to said central tube section with said connection end face opposing the end face of said central tube section, said intake tube section defining an internal passageway between said distal end face and said connection end face with the internal passageway of said intake tube section being in communication with the internal passageway of said central tube section; and a flared tube section having a mold end face and a connection end boundary with an outer surface between said mold end face and said connection end boundary, said flared tube section being secured to said central tube section with said connection end boundary opposing the end boundary of said central tube section, said flared tube section defining an internal passageway between said mold end face and said connection end boundary with the internal passageway of said flared tube section being in communication with the internal passageway of said central tube section, the outer surface of said flared tube section having a circumference at a given longitudinal position that is greater than the circumference at longitudinal positions between the given position and the connector end boundary, said flared tube section also including a flange ring that is located at a longitudinal position that is adjacent to the mold end of said flared tube section said flange ring having a circumferential surface that is separated from the outer surface of said flared tube section that is adjacent to said flange ring by an upper lateral side and by a lower lateral side, said lower lateral side including a radial edge with a first portion of the lower lateral side being located on one side of the radial edge and also being located between the radial edge and the outer surface of the flared tube section that is adjacent to said flange ring, said lateral side also having a second portion that is located on the opposite side of the radial edge from the first portion and that defines a recess, the first portion of the lateral side cooperating with the vessel to form a metal-to-refractory seal at times when the pressure cast tube is placed in the vessel; and a collar that is secured to the flange ring, said collar including an annular band that is secured to the circumferential surface of the flange ring, said collar further including a contact ring that is connected to said annular band, said contact ring being received in the recess of the second portion of said lateral side, said contact ring contacting the vessel at times when the pressure cast tube is placed in the vessel.

8. A pressure cast tube for conveying molten metal from a vessel to a casting, said tube comprising:

a tube body having an intake end and a mold end, said tube body defining an internal passageway between said intake end and said mold end, a portion of said tube body adjacent said mold end defining a fustrum with the base of said fustrum closer to said mold end than the top of said fustrum, said tube body further including a flange ring that is located between the mold end of said tube body and the base of said fustrum, said flange ring having a circumferential surface that extends laterally beyond the base of said fustrum to form a lateral face between said base and the circumferential surface of said flange ring, the lateral face of said flange ring including a radial edge with a first portion of the lateral face being located on one side of the radial edge and between the radial edge and the base of said fustrum, said lateral face further including a second portion that is located on the opposite side of the radial edge from the first portion and defining a recess, the first portion of the lateral face cooperating with the vessel to form a metal-to-refractory seal at times when the pressure cast tube is placed in the vessel;

a contact ring that is received in the recess of the second portion of said lateral face and that is secured to the lateral face of said flange ring, said contact ring having an outer perimeter and at least one planar face, the thickness of the contact ring being substantially equal to the depth of the recess of said lateral face, such that the first portion of the lateral face is substantially coplanar with the planar face of said contact ring; and a shell that is secured to the circumferential surface of said flange ring, said shell also being secured to the outer perimeter of said contact ring with said contact ring contacting the vessel at times when the pressure tube is placed in the vessel.

9. The pressure cast tube of claim 8 wherein said tube body defines an outer surface between the intake end and the base of said fustrum and wherein said contact ring defines an inner radial edge that is located laterally outwardly from the outer surface of said tube body and wherein the lateral face of said flange ring defines an annular recess and wherein the contact ring is received in the annular recess.

10. The pressure cast tube of claim 9 wherein the radially inner boundary of the annular recess is defined by a circular edge that opposes the inner radial edge of the contact ring when the contact ring is received in the annular recess.

11. The pressure cast tube of claim 10 wherein the portion of the lateral face of said flange ring that is defined between the circular edge of the annular recess and the base of said fustrum is substantially coplanor with the face of said contact ring when the contact ring is received in the annular recess.

* * * * *